US007204568B2

(12) United States Patent
Lim et al.

(10) Patent No.: US 7,204,568 B2
(45) Date of Patent: Apr. 17, 2007

(54) SEALING STRUCTURE OF REFRIGERATOR

(75) Inventors: Hyoung Keun Lim, Suwon-si (KR); Yang Gyu Kim, Seoul (KR); Se Young Kim, Seoul (KR); Chan Ho Chun, Seoul (KR); Youn Seok Lee, Goyang-si (KR)

(73) Assignee: LG Electronics Inc., Seoul (KR)

( * ) Notice: Subject to any disclaimer, the term of this patent is extended or adjusted under 35 U.S.C. 154(b) by 239 days.

(21) Appl. No.: 10/972,333

(22) Filed: Oct. 26, 2004

(65) Prior Publication Data

US 2005/0110375 A1 May 26, 2005

(30) Foreign Application Priority Data

Nov. 26, 2003 (KR) ..... 10-2003-0084352

(51) Int. Cl.
*A47B 95/00* (2006.01)

(52) U.S. Cl. ..... 312/296; 277/645; 277/921

(58) Field of Classification Search ..... 312/296, 312/401, 405; 49/475.1, 477.1, 489.1, 495.1, 49/498.1; 277/645, 646, 921
See application file for complete search history.

(56) References Cited

U.S. PATENT DOCUMENTS 2,451,450 A * 10/1948 Spraragen ..... 49/498.1
3,851,420 A * 12/1974 Tibbetts ..... 49/471
5,297,360 A * 3/1994 Besore et al. ..... 49/484.1
5,988,709 A * 11/1999 Lee et al. ..... 292/199
7,066,473 B2 * 6/2006 Arata et al. ..... 277/652
2005/0178069 A1 * 8/2005 Iwasa et al. ..... 49/498.1

FOREIGN PATENT DOCUMENTS

JP 10259983 * 9/1998
JP 2003065664 * 3/2003
KR 1999 0042588 6/1999

* cited by examiner

*Primary Examiner*—Janet M. Wilkens
(74) *Attorney, Agent, or Firm*—Greenblum & Bernstein, P.L.C.

(57) ABSTRACT

A sealing structure for a refrigerator is provided. The structure includes a gasket formed at a door of the refrigerator and at least two air pockets provided in the gasket. There is at least one connector, which separates the at least two air pockets from each other, and first convection cut-off members provided inside of the at least two air pockets. Additionally, the seal structure includes an inner case provided at an interior side of the refrigerator; a door liner, which lines the door, provided at an interior side of the refrigerator; and an air dam provided between the inner case and the door liner. Further, second convection cut-off members are provided in the air dam.

16 Claims, 10 Drawing Sheets

SEALING STRUCTURE OF REFRIGERATOR

BACKGROUND OF THE INVENTION

1. Field of the Invention

The present invention relates to a sealing structure of a refrigerator, and more particularly, to a sealing structure of a refrigerator in which external heat can be effectively prevented from being transferred to an internal of a refrigerator.

2. Description of the Related Art

Generally, a refrigerator discharges cool air, which is generated through a refrigerating cycle using a compressor, a condenser, an expansion valve and an evaporator, to drop an internal temperature of the refrigerator, thereby refrigerating or cooling foods.

FIG. 1 is a view illustrating a door of a related-art refrigerator.

Referring to FIG. 1, the door 10 includes a door exterior 20 formed of iron, and a door liner 30 formed by vacuously shaping Acrylonitrile-ButadieneStyrene (ABS) resin to have a predetermined shape. Additionally, the door 10 includes urethane foam 40 for thermal insulation between the door exterior 20 and the door liner 30.

Alternatively, a gasket is installed at the door liner 30 to prevent the leakage-out of cool air of the refrigerator to the external and concurrently, to cut-off an introduction of external heat into the refrigerator, thereby insulating the internal of the refrigerator from the external. A description thereof is made in FIG. 2.

FIG. 2 is a sectional view illustrating a sealing structure of a related-art refrigerator, and FIG. 3 is an enlarged view illustrating "A" portion of FIG. 2.

Referring to FIGS. 2 and 3, the refrigerator includes a door 10 installed at a front portion thereof, a door exterior 20 constituting an exterior of the door 10, a door liner 30 combined to the door exterior 20, and urethane foam 40 formed between the door exterior 20 and the door liner 30.

Further, the refrigerator includes an outer case 60 made of an iron plate, and an inner case 70 connected with the outer case 60. Additionally, the refrigerator includes an air dam 80 provided between the door liner 30 and the inner case 70, and a gasket 50 fixed to the door liner 30.

In detail, the gasket 50 includes a magnet 51, and a cohering part 52 for allowing the door 10 to be cohered to a front surface of a body of the refrigerator by using a magnetic force of the inserted magnet 51, thereby sealing the refrigerator itself.

Further, the gasket 50 is integrated with a lower portion of the cohering part 52. The gasket 110 includes a first connection part 53, a second connection part 54, and a third connection part 55, which function as barriers for forming a predetermined space at a lower portion of the cohering part 52. Additionally, the gasket 50 includes a first air pocket 56 provided by the first connection part 53 and the second connection part 54; and a second air pocket 57 provided by the second connection part 54 and the third connection part 55.

Further, the gasket 50 is installed at a lower portion of the refrigerator. The gasket 50 includes an anchor-shaped combining part 58 for allowing the cohering part 52, the first connection part 53, the second connection part 54, and the third connection part 55 to be inserted and fixed to a combination groove provided at the door liner 30.

Hereinafter, an operation of opening and closing the related-art refrigerator door is described.

First, if a user pushes the door 10 to close the door 10, the door 10 is closed to a whole surface of a body of the refrigerator, thereby attaching the cohering part 52 to the outer case 60 by a magnetism of the magnet 51. Additionally, the attachment causes the refrigerator to be completely cut off from the external by a sealing function of the gasket 50.

Alternatively, if the user pulls the door 10 to open the door 10, a tensile load acts to cause the door liner 30 to pull the combining part 58. Additionally, the tensile load causes the first connection part 53, the second connection part 54 and the third connection part 55 to be pulled, and also the cohering part 52 to be pulled. Accordingly, the magnet 51 is separated from the outer case 60, and the separation causes the body of the refrigerator to be opened.

As such, the gasket 50 used at the door 10 should function to maintain strong airtightness between the door 10 and the body. That is, the gasket 50 should effectively perform an insulation function to cut off the leakage of the cool air from the internal of the refrigerator to the external, and concurrently to cut off a heat transfer from the external to the internal of the refrigerator.

Alternatively, the first connection part 53 is exposed to a room temperature of the external air, and the third connection par 55 is exposed to the cool air of the refrigerator. Accordingly, a temperature difference between the external air and the cool air generates natural convection in the first air pocket 56 and the second air pocket 57 at one side of which the third connection part 55 is formed.

Further, the external heat transferred to the first connection part 53 is transferred to the second connection part 54 by air circulation of within the first air pocket 56. Additionally, the heat transferred to the second connection part 54 is transferred to the third connection part 55 by air circulation of within the second air pocket 57. Additionally, the heat transferred to the third connection part 55 causes the nature convection in the air dam 80. Additionally, the heat is transferred to the cool air of within the refrigerator by the natural convection.

However, the related-art gasket does not have a structure for preventing the natural convection generated in the air pocket and/or the air dam. Accordingly, there is a drawback in that an internal temperature of the refrigerator increases and a cooling performance of the refrigerator is greatly reduced due to intact transference of the external heat to the internal of the refrigerator through the natural convection.

SUMMARY OF THE INVENTION

Accordingly, the present invention is directed to a sealing structure of a refrigerator that substantially obviates one or more problems due to limitations and disadvantages of the related art.

An object of the present invention is to provide a sealing structure of a refrigerator in which external heat can be effectively prevented from being transferred to an internal of a refrigerator.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a sealing structure of a refrigerator, the structure including: a gasket formed at a door of the refrigerator; at least one air pocket formed at the gasket; and at least one convection cut-off member disposed in the air pocket, for suppressing natural convection.

In another aspect of the present invention, there is provided a sealing structure of a refrigerator, the structure including: an inner case formed at a body of the refrigerator; a door liner formed at a door of the refrigerator, the door being combined to a whole surface of the body of the refrigerator; an air dam provided by the inner case and the door liner; and at least one convection cut-off member positioned at the inner case and/or the door liner, for suppressing natural convection in the air dam.

The present invention has an effect in that at least one pile formed in the air pocket can cut off the heat of the external air, which can be transferred to the internal of the refrigerator through the air circulation caused by the natural convection of within the air pocket.

Further, the present invention has an effect in that at least one pile formed in the air dam can cut off the heat of the external air, which can be transferred to the internal of the refrigerator through the air circulation caused by the natural convection of within the air dam.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

It will be understood that a sealing structure of a refrigerator according to the present invention can be applied to all of a top type refrigerator having a freezing chamber installed at an upper portion thereof and a cool chamber installed at a lower portion thereof, a bottom type refrigerator having a freezing chamber installed at a lower portion thereof and a cool chamber installed at an upper portion thereof, and a side by side type refrigerator having a freezing chamber and a refrigerating chamber installed at left and right sides of a main body.

Figure 1:
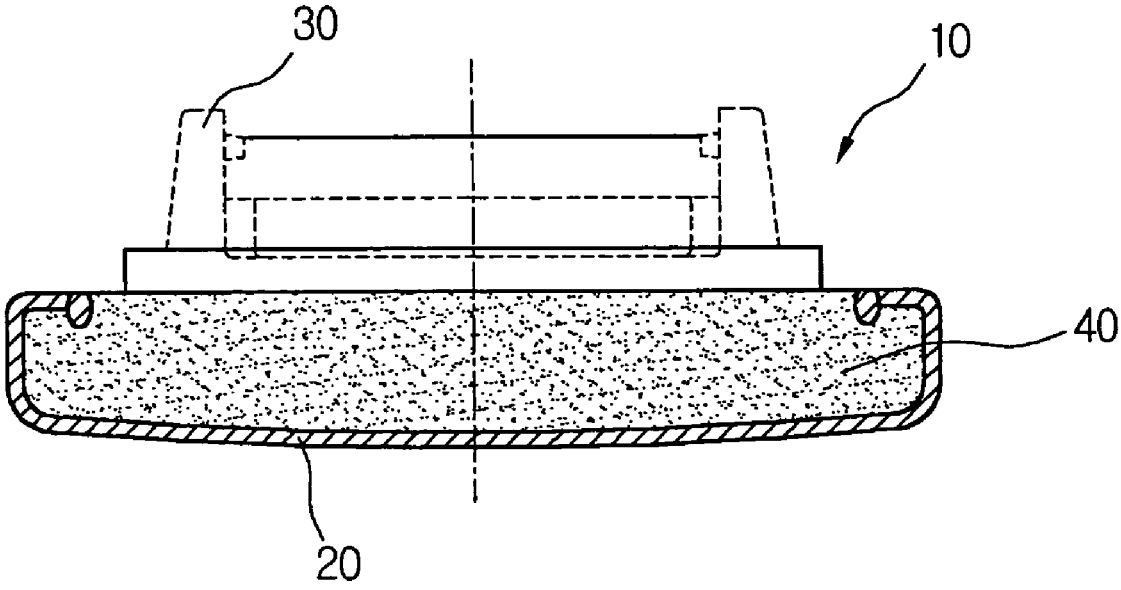
Fig.1 Related Art
FIG. 1 is a view illustrating a door of a related-art refrigerator.
Figure 2:
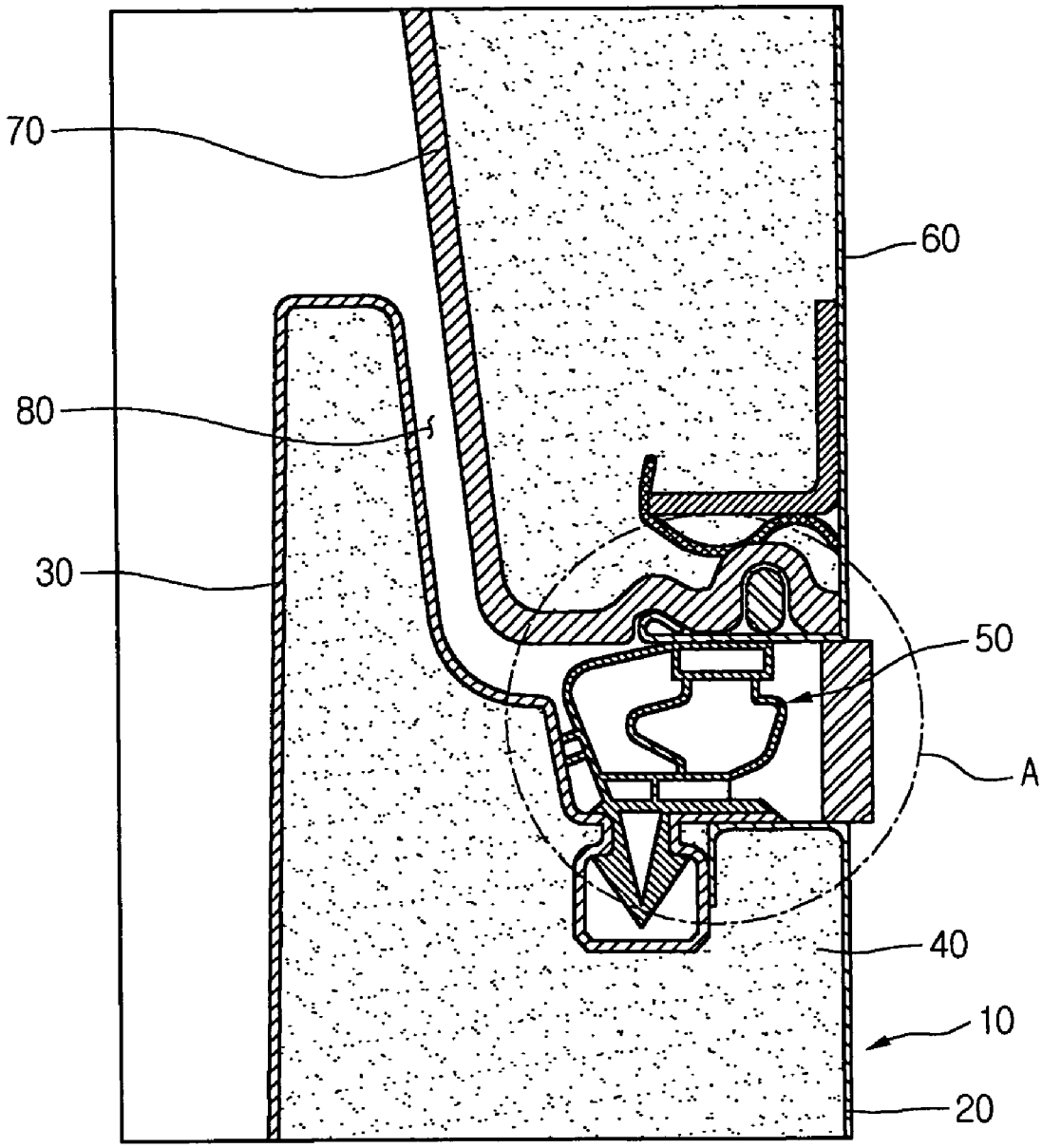
Fig.2 Related Art
FIG. 2 is a sectional view illustrating a sealing structure of a related-art refrigerator.
Figure 3:
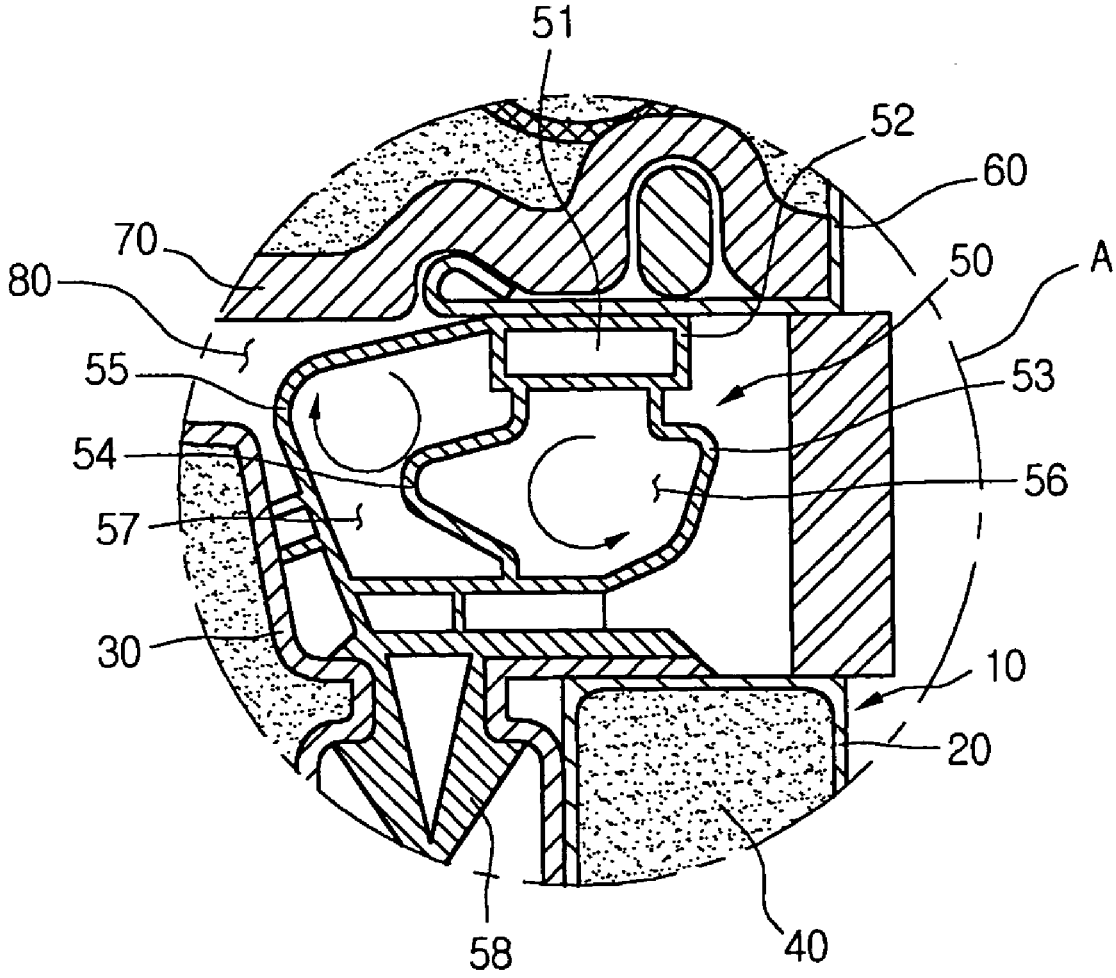
Fig.3 Related Art
FIG. 3 is an enlarged view illustrating "A" portion of FIG. 2.
Figure 4:
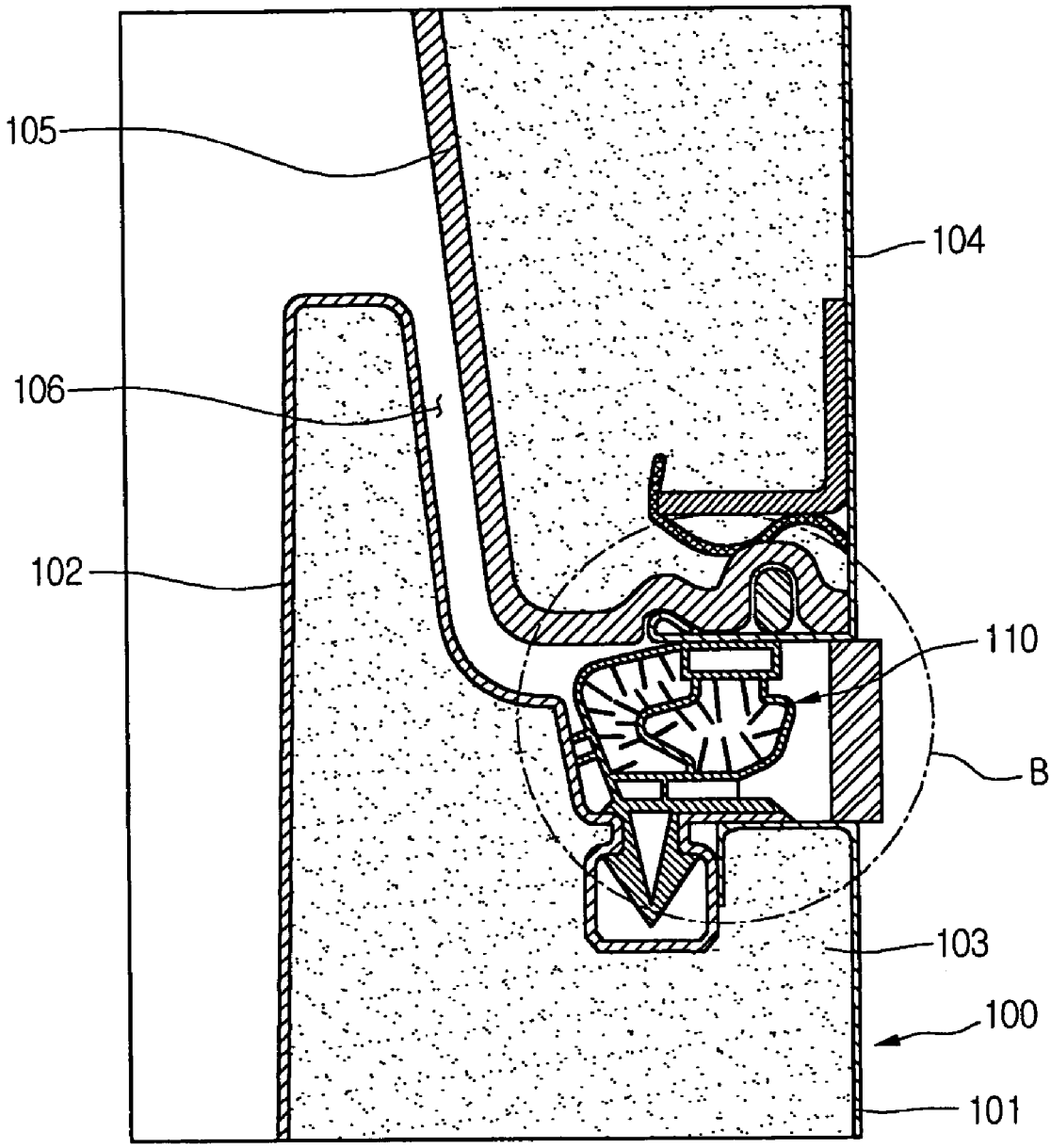
FIG. 4 is a sectional view illustrating a sealing structure of a refrigerator according to the present invention.
Figure 5:
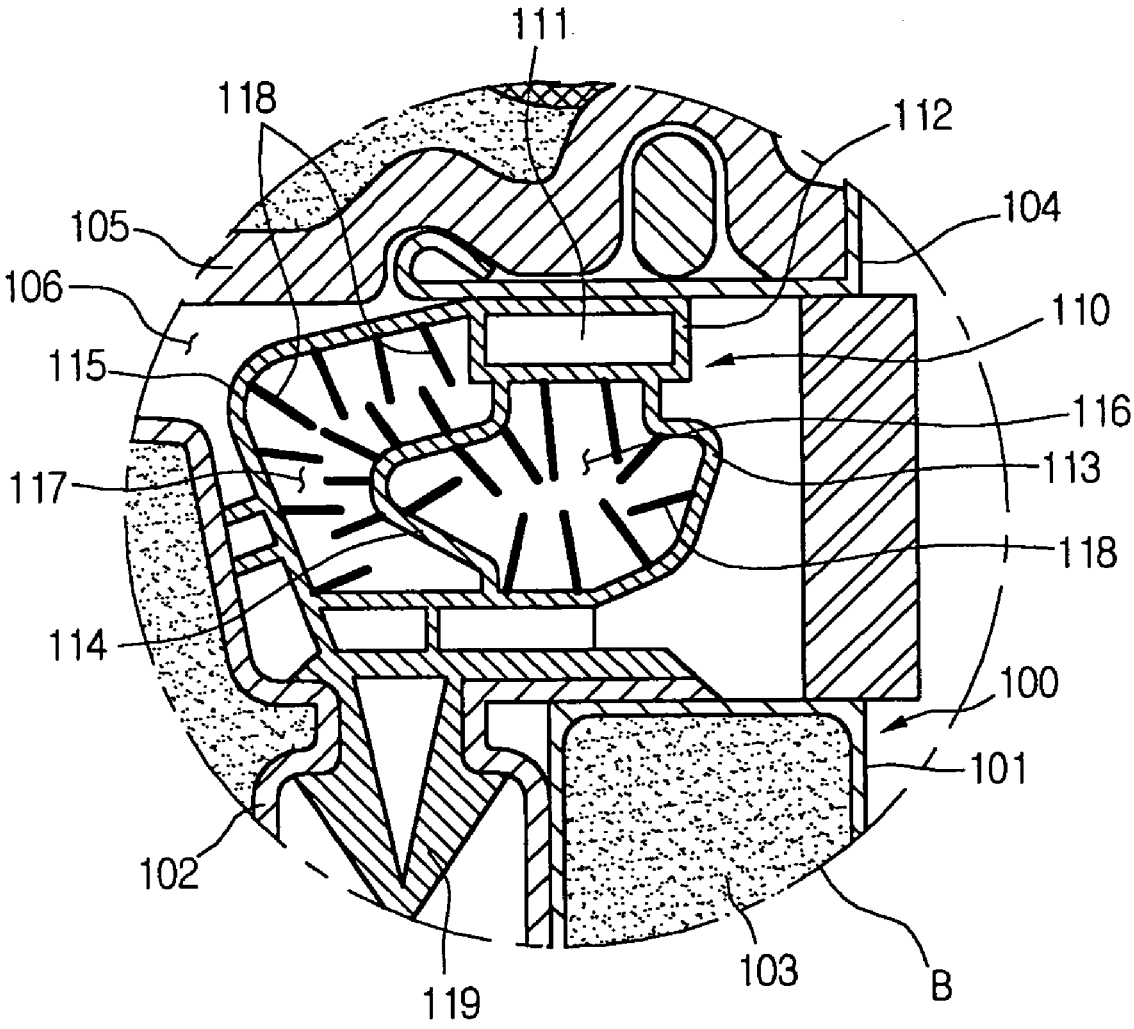
FIG. 5 is an enlarged view illustrating "B" portion of FIG. 4.

FIG. 4 is a sectional view illustrating a sealing structure of a refrigerator according to the present invention, and FIG. 5 is an enlarged view illustrating "B" portion of FIG. 4.

Referring to FIGS. 4 and 5, the inventive refrigerator includes a door 100 installed at a front portion; a door exterior 101 constituting the exterior of the door; a door liner 102 combined to the door exterior; and a urethane foam 103 provided between the door exterior 101 and the door liner 102.

Further, the refrigerator includes an outer case 104 made of an iron plate; and an inner case 105 connected with the outer case 104. Additionally, the refrigerator includes an air dam 106 provided between the door liner 102 and the inner case 105; and a gasket 110 fixed to the door liner 102.

In detail, the gasket 110 includes a magnet 111, and a cohering part 112 for allowing the door 100 to be cohered to a front surface of a body of the refrigerator by using a magnetic force of the inserted magnet 111, thereby sealing the refrigerator itself.

Further, the gasket 110 is integrated with a lower portion of the cohering part 112. The gasket 110 includes a first connection part 113, a second connection part 114, and a third connection part 115 which function as barriers for forming a predetermined space at a lower portion of the cohering part 112. Additionally, the gasket 110 includes a first air pocket 116 provided by the first connection part 113 and the second connection part 114; and a second air pocket 117 provided by the second connection part 114 and the third connection part 115.

Further, the gasket 110 includes at least one pile 118 for preventing natural convection from being generated within the first air pocket 116 and/or the second air pocket 117.

Furthermore, the gasket 110 is installed at a lower portion of the refrigerator. The gasket 110 includes an anchor-shaped combining part 119 for allowing the cohering part 112, the first connection part 113, the second connection part 114, and the third connection part 115 to be inserted and fixed to a combination groove provided at the door liner 102.

Here, it will be understood that the connection part and the air pocket provided by the connection part are not limited in number in this embodiment, and can be variously provided in number within a scope of achieving an object for cutting-off an internal of the refrigerator from the external.

Alternatively, the pile 118 is protruded to have a predetermined length at an inner circumference of the air pocket where the pile 118 is formed, such that mutual facing files 118 are not interfered with each other when the door 100 is opened or closed.

At this time, the pile 118 preferably has a protrusion length, which is 0.3 to 0.4 times as much as an average diameter of the air pocket where the pile 118 is formed.

Furthermore, the piles 118 have ends, which are preferably spaced apart by 0.4 times as much as the average diameter of the air pocket in order to prevent interference between the mutually facing piles 118.

Additionally, the piles 118 are preferably formed to have a velvet shape of a pile textile.

Further, the pile 118 is preferably formed at a whole of the connection part at which the pile 118 is formed.

Figure 6:
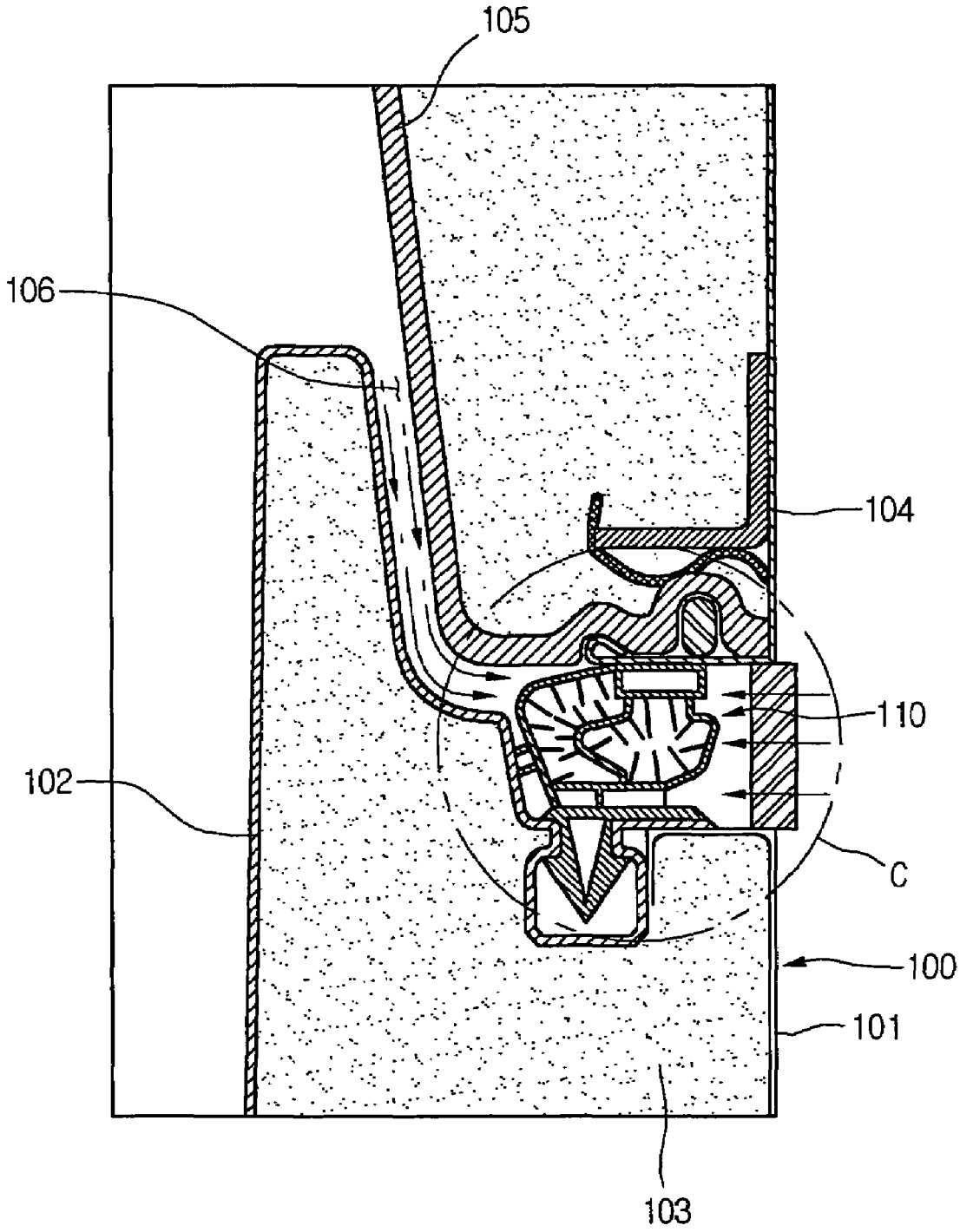
FIG. 6 is a sectional view illustrating an operation of a sealing structure of a refrigerator according to the present invention.
Figure 7:
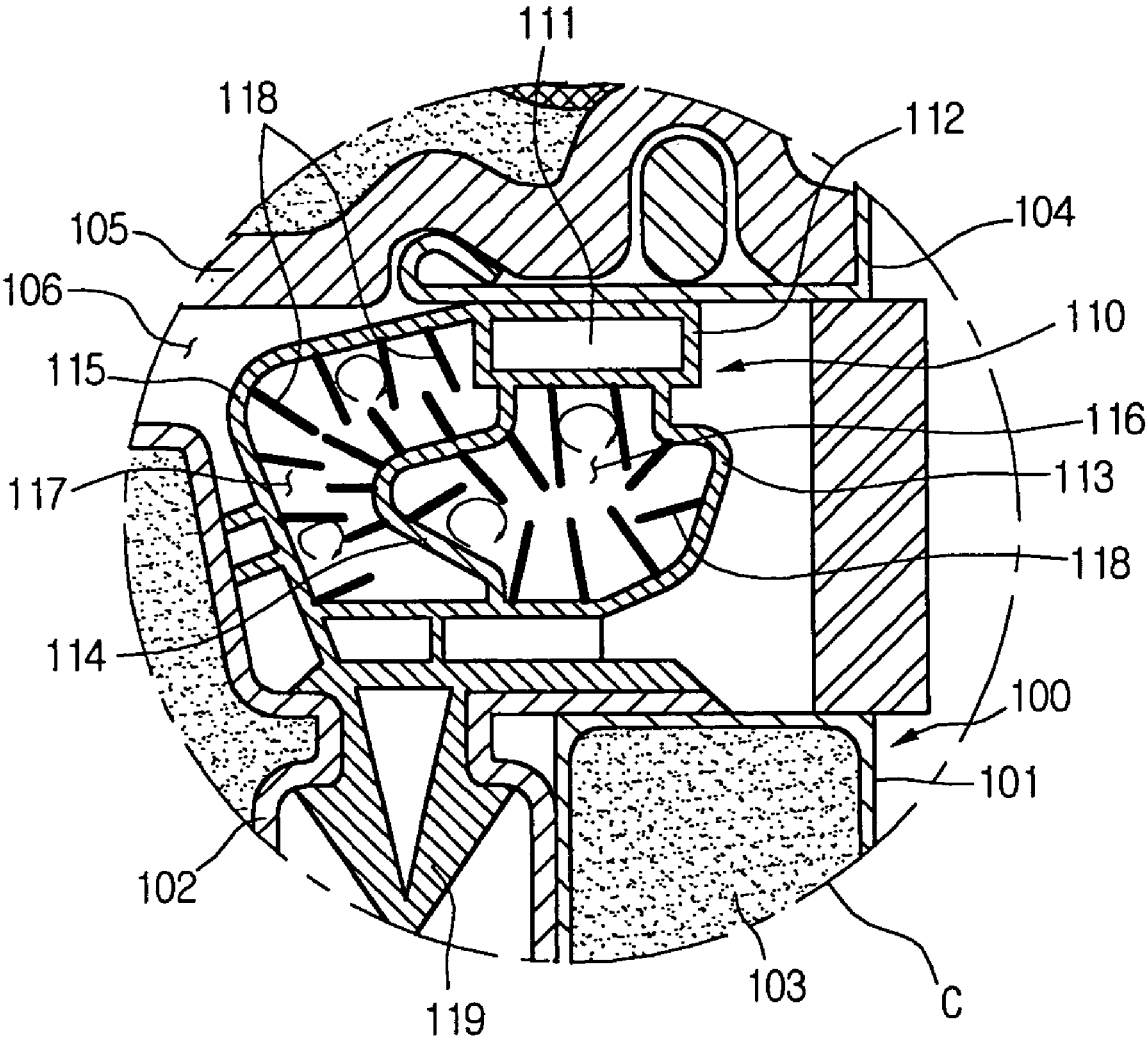
FIG. 7 is an enlarged view illustrating "C" portion of FIG. 6.

FIG. 6 is a sectional view illustrating an operation of a sealing structure of a refrigerator according to the present invention, and FIG. 7 is an enlarged view illustrating "C" portion of FIG. 6.

Elements and their reference numerals of FIGS. 6 and 7 are the same as those of FIGS. 4 and 5. Accordingly, a duplicate description thereof is omitted.

First, if a user closes the door 100 to close the body of the refrigerator, the cohering part 112 is attached to the outer case 104 by a magnetism of the magnet 111. Additionally, the attachment allows the first air pocket 116 and the second air pocket 117 to stop the space provided between the door 100 and the body of the refrigerator. Accordingly, the gasket 110 performs a sealing function to completely cut off and seal the refrigerator from the external.

Alternatively, the first connection part 113 is exposed to a room temperature of the external air such that heat of the external air is transferred to the first air pocket 116 at one side of which the first connection part 113 is provided. Additionally, the third connection part 115 is exposed to cool air within the refrigerator such that the cool air is transmitted to the second air pocket 117 at one side of which the third connection part 115 is provided.

Accordingly, a temperature difference is generated between the external air and the cool air. The natural convection can be generated, due to the temperature difference, in the first air pocket 116 and the second air pocket 117.

The present invention has the pile 118 to suppress air circulation caused by the natural convection, which can be generated in the first air pocket 116 and the second air pocket 117. Therefore, the heat of the external air can be prevented from being transferred to the internal of the refrigerator.

Alternatively, if the user pulls the door 100 to open the door 100, a tensile load acts to allow the door liner 102 to pull the combining part 119. Additionally, due to the tensile load, the first connection part 113, the second connection part 114 and the third connection part 115 are pulled and also the cohering part 112 is pulled. Accordingly, the magnet 111 is separated from the outer case 104 to open the body of the refrigerator.

Figure 8:
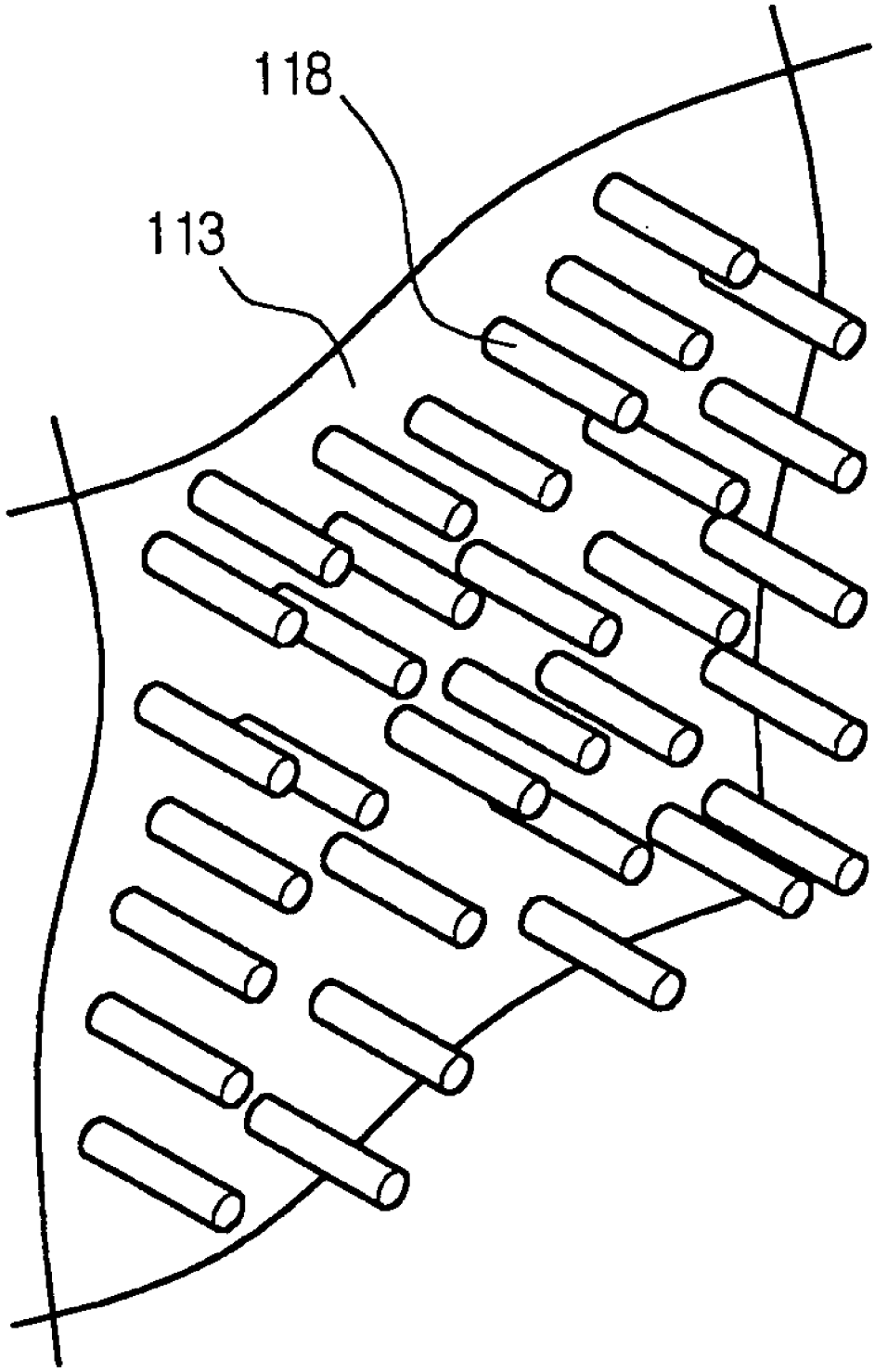
FIG. 8 is a view illustrating a pile applied to a sealing structure of a refrigerator according to one embodiment of the present invention.

FIG. 8 is a view illustrating a pile applied to the sealing structure of the refrigerator according to one embodiment of the present invention.

Referring to FIG. 8, the pile 118 has a circular, triangular or rectangular section and is protruded in an irregular array.

Here, the pile 118 can be also regularly arrayed. However, since the pile 118 is formed to suppress the air circulation in the air pocket where the pile 118 is formed, it is desirable that the pile 118 is irregularly arrayed, thereby more effectively suppressing a flow of air.

Figure 9:
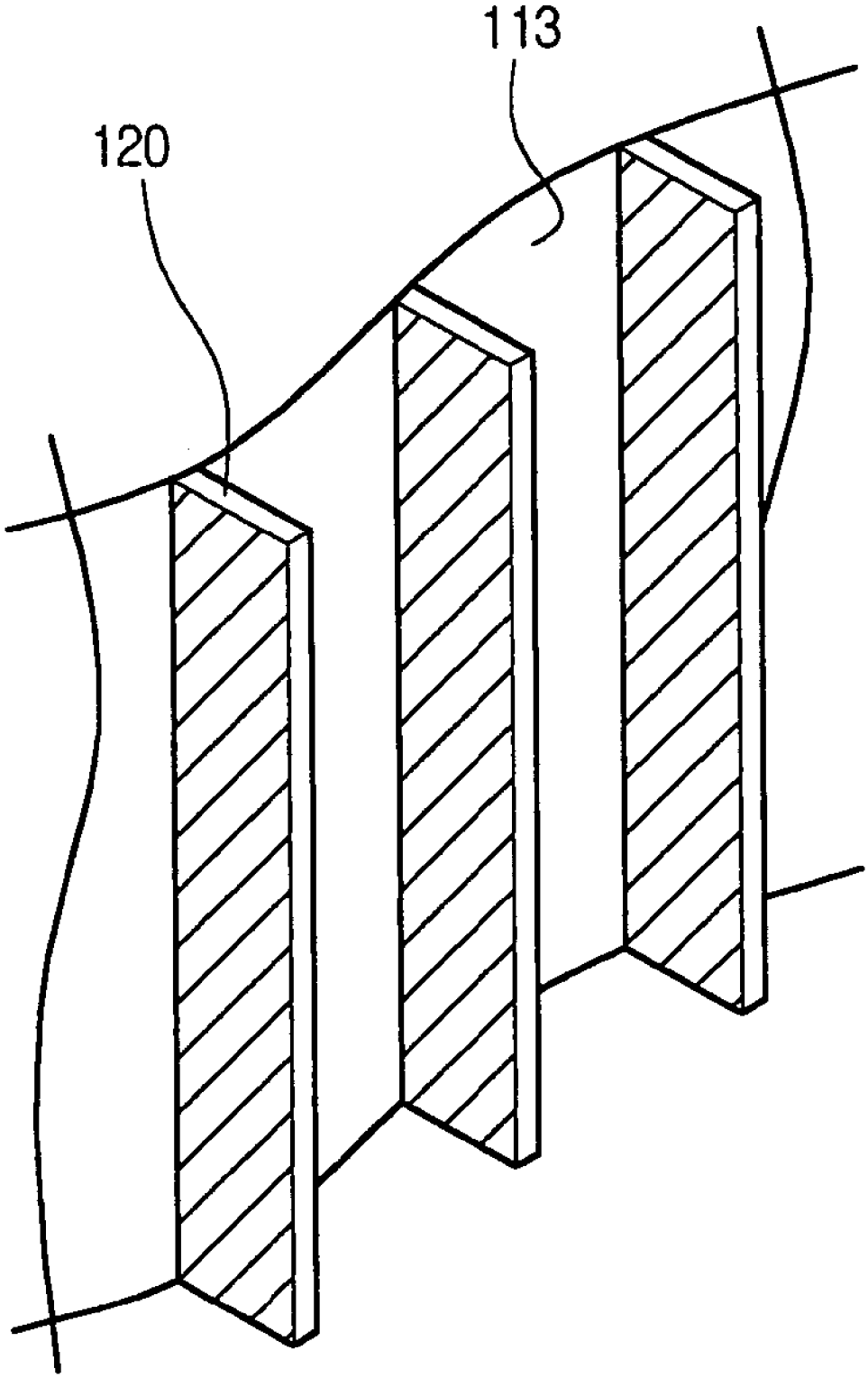
FIG. 9 is a view illustrating a pile applied to a sealing structure of a refrigerator according to another embodiment of the present invention.

FIG. 9 is a view illustrating a pile applied to the sealing structure of the refrigerator according to another embodiment of the present invention.

Referring to FIG. 9, the pile 120 is band-shaped lengthwise, and is consecutively arrayed such as a hurdle.

Here, the pile 120 has a length that is preferably directed and arrayed appropriately vertically to a direction of the air circulation to effectively suppress the air circulation in the air pocket where the pile 120 is formed.

Figure 10:
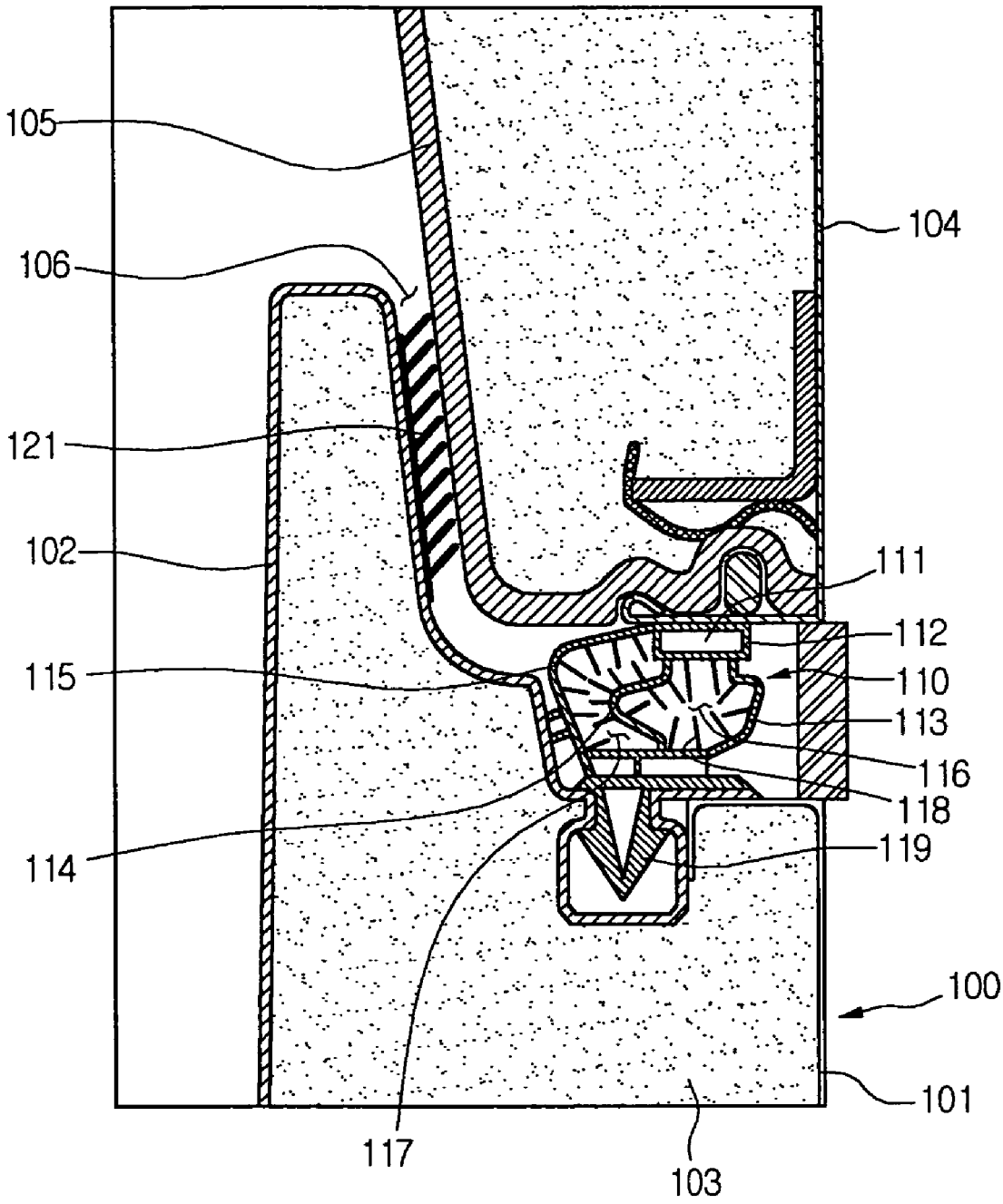
FIG. 10 is a view illustrating a state of a pile structure installed at an air dam according to the present invention.

FIG. 10 is a view illustrating a state of a pile structure installed in the air dam according to the present invention.

Referring to FIG. 10, the inventive refrigerator includes the door 100 installed at the front portion thereof; the door exterior 101 constituting an exterior of the door; the door liner 102 combined to the door exterior; and the urethane foam 103 provided between the door exterior 101 and the door liner 102.

Further, the refrigerator includes the outer case 104 made of the iron plate; and the inner case 105 connected with the outer case 104. Additionally, the refrigerator includes the air dam 106 provided between the door liner 102 and the inner case 105; and the gasket 110 fixed to the door liner 102.

Furthermore, the refrigerator includes at least one file 121 that is formed at the door liner 102 and/or the inner case 105 for forming the air dam 106 and prevents the natural convection from being generated in the air dam 106.

In detail, the gasket 110 includes a magnet 111; a cohering part 112 into which the magnet 111 is inserted; a first connection part 113; a second connection part 114; and a third connection part 115. Additionally, the gasket 110 includes a first air pocket 116 provided by the first connection part 113 and the second connection part 114; and a second air pocket 117 provided by the second connection part 114 and the third connection part 115. Further, a combining part 119 is formed at a lower portion of the gasket 110.

Further, the gasket 110 includes at least one pile 118 for preventing natural convection from being generated in the first air pocket 116 and/or the second air pocket 117.

Here, the pile 121 preferably has a little shorter than an interval between the door liner 102 and the inner case 105 facing with the door liner 102.

Further, it is desirable that the pile 121 is slanted at a predetermined angle to be appropriately vertical with respect to an air dam 106 such that the air circulation can be effectively suppressed in the air dam 106.

Furthermore, the pile 121 is formed of a soft material to prevent inconvenience at the time of opening and closing of the door 100. The pile 121 is preferably formed at a whole of the door liner 102 and/or the inner case 105.

Hereinafter, operations of the sealing structure and the pile according to the present invention are described.

First, if the user closes the door 100 to seal the body of the refrigerator, the cohering part 112 is attached to the outer case 104 by the magnetism of the magnet 111. Additionally, the attachment of the cohering part 112 causes the first air pocket 116 and the second air pocket 117 to stop the space between the door 100 and the body of the refrigerator. Accordingly, since the gasket 110 performs the sealing function, the refrigerator is completely cut off and sealed from the external.

Alternatively, the first connection part 113 is exposed to the room temperature of the external air such that the heat of the external air is transferred to the first air pocket 116 at one side of which the first connection part 113 is formed. Additionally, the third connection part 115 is exposed to the cool air of the refrigerator such that the cool air is transferred to the second air pocket 117 at one side of which the third connection part 115 is formed.

Accordingly, a temperature difference is generated between the external air and the cool air. The temperature difference causes the natural convection of air to be generated in the first air pocket 116 and the second air pocket 117.

Further, the external heat transferred to the first connection part 113 is transferred to the second connection part 114 by the air circulation of within the first air pocket 116. Additionally, the heat transferred to the second connection part 114 is transferred to the third connection part 115 by the air circulation of within the second air pocket 117. Additionally, the heat transferred to the third connection part 115 causes the natural convection of within the air dam 106. Additionally, the natural convection causes the heat to be transferred to the cool air of within the refrigerator.

The present invention has the pile 118 within the first air pocket 116 and the second air pocket 117 to suppress the air circulation caused by the natural convection, which can be generated within the first air pocket 116 and the second air pocket 117. Therefore, the heat of the external air can be primarily prevented from being transferred to the internal of the refrigerator.

Further, the pile 121 is provided in the air dam 106 such that the air circulation can be suppressed in the air dam 106. Therefore, the heat of the external air transferred to the air dam 106 can be secondarily prevented from being transferred to the internal of the refrigerator.

As described above, the present invention has an effect in that at least one pile formed in the air pocket can cut off the heat of the external air, which can be transferred to the internal of the refrigerator through the air circulation caused by the natural convection of within the air pocket.

Further, the present invention has an effect in that at least one pile formed in the air dam can cut off the heat of the external air, which can be transferred to the internal of the refrigerator through the air circulation caused by the natural convection of within the air dam.

It will be apparent to those skilled in the art that various modifications and variations can be made in the present invention. Thus, it is intended that the present invention covers the modifications and variations of this invention provided they come within the scope of the appended claims and their equivalents.

What is claim is:

1. A sealing structure of a refrigerator, the structure comprising:

a gasket formed at a door of the refrigerator;

at least two air pockets provided in the gasket, wherein at least one connector separates the at least two air pockets from each other, and wherein first convection cut-off members are provided inside of the at least two air pockets;

an inner case provided at an interior side of the refrigerator;

a door liner, which lines the door, provided at an interior side of the refrigerator;

an air dam provided between the inner case and the door liner; and second convection cut-off members provided in the air dam.

2. The structure according to claim 1, wherein the first convection cut-off members each have a generally cylindrical shape.

3. The structure according to claim 1, wherein collectively the first convection cut-off members are velvety.

4. The structure according to claim 1, wherein the first convection cut-off members are protruded at a predetermined length.

5. The structure according to claim 1, wherein the first convection cut-off members are facing each other and have ends spaced apart by a predetermined distance.

6. The structure according to claim 1, wherein the convection cut-off members are irregularly arrayed.

7. The structure according to claim 1, wherein the first convection cut-off members have either one of a circular, or rectangular cross-section.

8. The structure according to claim 1, wherein the first convection cut-off members each have a generally rectangular shape.

9. The structure according to claim 8, wherein the first convection cut-off members are arranged in series and extend generally parallel to each other.

10. The structure according to claim 8, wherein the first convection cut-off members have a length that is directed at a predetermined angle with respect to a direction of air circulation within the at least two air pockets.

11. The structure according to claim 1, wherein the first convection cut-off members are positioned at the at least one connector.

12. The structure according to claim 11, wherein the first convection cut-off members are formed entirely at the at least one connector.

13. The structure according to claim 1, wherein the convection cut-off members facing each other have ends spaced apart by a predetermined distance when the door is either opened or closed.

14. The structure according to claim 1, wherein the second convection cut-off members have a length shorter than an interval between the door liner and the inner case which faces the door liner.

15. The structure according to claim 1, wherein the second convection cut-off members are slanted at a predetermined angle with respect to the air dam.

16. The structure according to claim 1, wherein the second convection cut-off members are entirely formed on either one of the door liner or the inner case.

* * * * *